US007988069B2

(12) United States Patent
Huffman et al.

(10) Patent No.: US 7,988,069 B2
(45) Date of Patent: Aug. 2, 2011

(54) SHOWER HEADER WITH REPLACEABLE INTERNAL CLEANING BRUSH ASSEMBLY

(75) Inventors: David C. Huffman, Merrimack, NH (US); Michel Thenin, Nashua, NH (US); Richard Gardner, St Charles, NH (US)

(73) Assignee: Spraying Systems Co., Wheaton, IL (US)

( * ) Notice: Subject to any disclaimer, the term of this patent is extended or adjusted under 35 U.S.C. 154(b) by 345 days.

(21) Appl. No.: 11/883,906

(22) PCT Filed: Feb. 7, 2006

(86) PCT No.: PCT/US2006/004063

§ 371 (c)(1),
(2), (4) Date: Sep. 7, 2007

(87) PCT Pub. No.: WO2006/086287

PCT Pub. Date: Aug. 17, 2006

(65) Prior Publication Data

US 2008/0257981 A1 Oct. 23, 2008

Related U.S. Application Data

(60) Provisional application No. 60/651,413, filed on Feb. 9, 2005.

(51) Int. Cl.
*B05B 15/04* (2006.01)

(52) U.S. Cl. ..... 239/116; 239/566

(58) Field of Classification Search ..... 239/1, 114–116, 239/566; 15/22.1, 23, 104.2, 104.5, 104.9
See application file for complete search history.

(56) References Cited

U.S. PATENT DOCUMENTS

| | | | | |
|---|---|---|---|---|
| 1,721,477 | A | 7/1929 | Spafford | |
| 5,664,731 | A | 9/1997 | Lemetyinen et al. | |
| 7,182,273 | B2 * | 2/2007 | Proulx, Jr. | 239/110 |
| 2004/0195353 | A1 | 10/2004 | Proulx, Jr. | |

* cited by examiner

*Primary Examiner* — Christopher S Kim
(74) *Attorney, Agent, or Firm* — Leydig, Voit & Mayer, Ltd.

(57) ABSTRACT

A shower header type spraying device having an elongated spray header with a plurality of laterally-spaced nozzles and an elongated cleaning brush assembly supported in said spray header for cleaning inlet apertures of said spray nozzles. The cleaning brush assembly includes an axially extending rod and a plurality of brush elements each mounted on the rod by means of a self-aligning member that has an arcuate shape corresponding to the outer circumference of the rod for orienting a row of brush bristles of the brush element in predetermined relation to the elongated axis of the rod. The illustrated brush rod assembly includes a plurality of brush rod segments each having a self-aligning coupling at an axial end thereof such that joining of adjacent rod segments automatically orients the brush elements in predetermined angular offset relation to each other.

14 Claims, 4 Drawing Sheets

SHOWER HEADER WITH REPLACEABLE INTERNAL CLEANING BRUSH ASSEMBLY

CROSS-REFERENCE TO RELATED APPLICATIONS

This patent application claims the benefit of U.S. Provisional Patent Application No. 60/651,413, filed Feb. 9, 2005.

FIELD OF THE INVENTION

This invention pertains generally to shower header-type liquid spraying systems, and in particular, to internal cleaning brush assemblies for such shower headers.

BACKGROUND OF THE INVENTION

Shower header-type liquid spraying systems are used in a variety of different industrial applications typically to direct fluid onto some sort of processing line, e.g., directing cleaning fluids onto rollers in pulp and paper mills and spraying cooling fluids onto processed metals in steel mills. Such spraying systems typically include a plurality of shower spray nozzle assemblies mounted in laterally spaced relation along a header so as to be able to direct a curtain of liquid onto the processing line. Since a single processing line can include a number of such shower headers, such spray systems use a substantial volume of cleaning, cooling or other processing fluids. As a result, to conserve processing fluid, it is common to collect the fluid discharge, filter out the debris and contaminants from the fluid during a recycling process, and reuse the liquid. Despite the filter system, some particulates and other matter can pass back into the headers. Over time, this can plug or impede liquid flow through the spray nozzles on the header.

To help clean out the spray nozzles, the shower headers can include an elongated brush assembly that can be rotated within the header in order to dislodge any debris from the shower spray nozzle assemblies. The brush assembly typically includes an elongated brush rod on which a plurality of brushes are arranged. The brushes are arranged at regular staggered intervals on the brush rod to provide maximum coverage of the interior of the shower header while minimizing the impediment to the flow of fluid through the shower header caused by the brushes.

From time to time, it becomes necessary to remove and replace the brushes and/or the brush rod due, for example, to excessive wear. Unfortunately, this can be very difficult to accomplish in the field. For instance, to ensure proper operation, the brush rod and brushes must be positioned and aligned precisely in the shower header. If the brush rod or brushes are off-center, the brushes can interfere excessively with the inside wall of the header hindering or even preventing rotation of the brush assembly. However, because the brush rod can be quite long, with lengths of forty feet or more not being uncommon, it can be very difficult to properly center the brush rod, and thus the brushes, in the shower header in the field where there are not any special fixtures to assist with the alignment process. As will be appreciated, providing special fixtures for each field replacement of a brush rod is simply not practical and in any event would be very expensive. Another problem with field replacement of the brush rod is that the length of the rod makes it difficult and expensive to ship.

Field replacement of just the brushes can also be difficult. The brushes are typically secured to the brush rod via welding. Again, to ensure that the brushes operate properly, they must be positioned precisely with respect to the axial centerline of the brush rod. When the shower header and brush assembly are initially fabricated in a plant, special fixtures are typically used to ensure the proper alignment of the brushes. However, as with the special fixtures for locating the brush rod, it is not practical to use the brush locating special fixtures for each field replacement of a brush.

OBJECTS AND SUMMARY OF THE INVENTION

It is an object of the present invention to provide a shower header having a brush assembly that is adapted for efficient mounting in precisely positioned relation with respect to an axis of the brush assembly for more reliable operation.

Another object is to provide a spray header brush assembly as characterized above which is adapted for easy field replacement and repair without special locating fixtures and the like for the brush elements.

A further object is to provide a spray header of the above kind in which the brush assembly is adapted for easy and less expensive shipment to customer sites or field locations.

Other objects and advantages of the invention will become apparent upon reading the following detailed description and upon reference to the drawings, in which:

Figure 1:
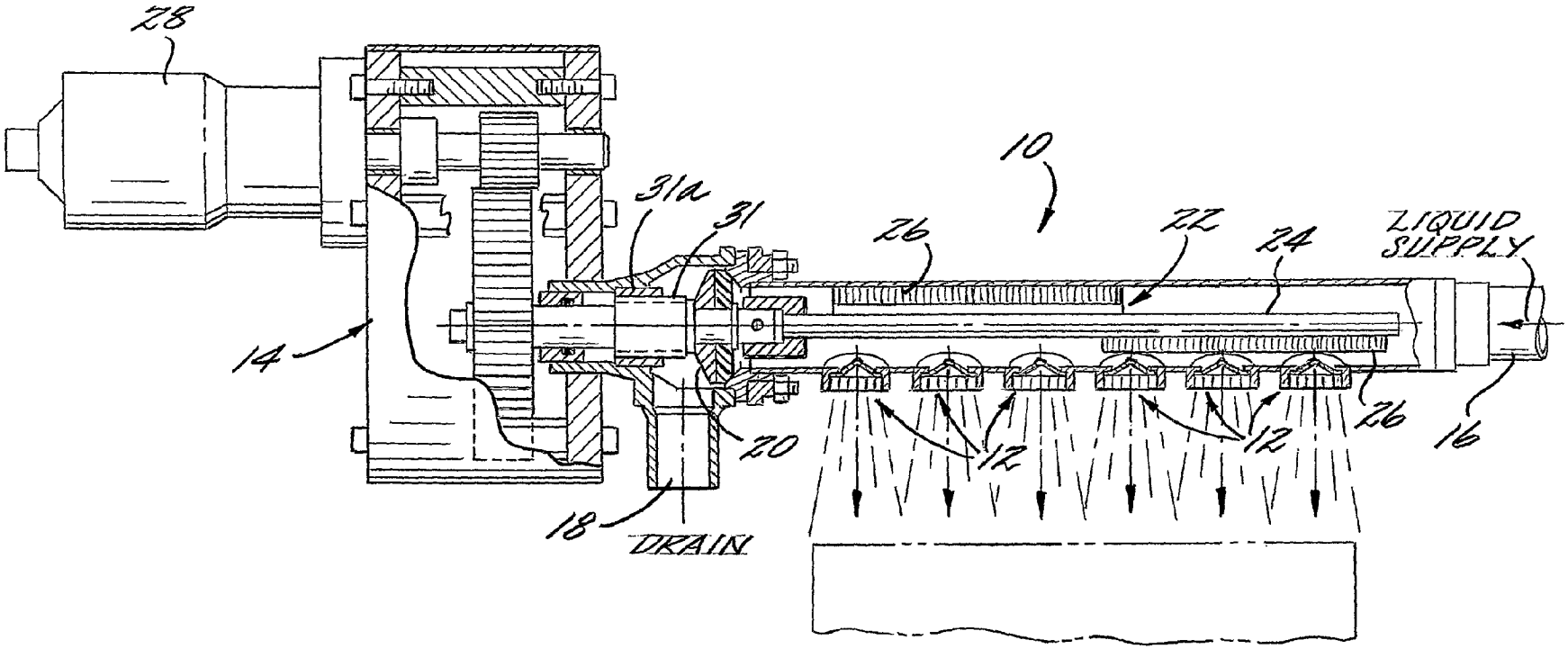
FIG. 1 is a longitudinal, section of an illustrative shower header having a brush assembly in accordance with the invention, in which the brush assembly is motor driven.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Referring to FIG. 1 of the drawings, there is shown an exemplary shower header 10 including a plurality of laterally spaced shower spray nozzle assemblies 12. The illustrated shower header 10 has particular utility in paper and steel processing applications in which an elongated curtain of liquid is emitted from the header. The illustrated shower header 10 is supported in cantilever relation from a support frame 14. The upstream end of the header 10 is connected to a pressurized liquid supply 16 and a drain pipe 18 communicates with the downstream end of the header. Pressurized fluid introduced through the upstream end of the header 10 travels through the header and is discharged via the spray nozzle assemblies 12. For directing the fluid spray, each shower spray nozzle assembly 12 includes a shower nozzle having a discharge orifice. Each of the shower nozzles is mounted within a receiving recess or pocket in a respective nozzle base in the underside of the header 10. In this case, a valve 20 is arranged at the downstream end of the header 10 for shutting off the flow of liquid to the shower spray nozzle assemblies 12.

To facilitate cleaning of the shower spray nozzle assemblies 12, a cleaning brush assembly 22 is arranged inside the illustrated header 10. The cleaning brush assembly 22 includes a brush rod 24 on which a plurality of brush elements 26 are arranged. The brush rod 24 can be a solid element, however, a hollow pipe is preferred for relatively long rods because of weight considerations. Each brush element 26 includes a conventional brush which in this instance includes cleaning bristles 27 extending radially from a narrow elongated support member 29. In the illustrated embodiment, each successive brush element 26 is staggered 120° from the preceding brush element along the rod 24 with each brush element slightly overlapping (e.g., ½ inch) the previous brush element in the axial direction in order to ensure complete coverage of the interior of the shower header 10 while minimizing the obstruction to the flow of fluid through the header by the brush elements 26.

Figure 2:
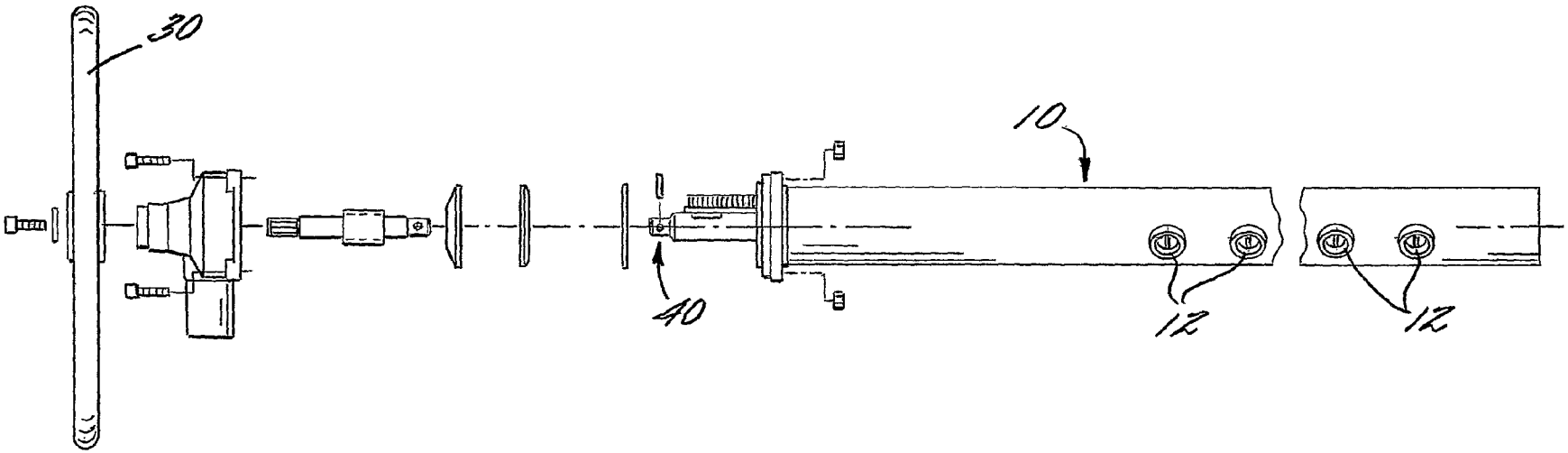
FIG. 2 is an exploded perspective of an alternative embodiment of shower header having a brush assembly that is rotatable via a hand wheel.

The cleaning brush assembly 22 is supported for both rotary and axial movement in the header 10 so as to be able to dislodge any debris or solid material that is encumbering or clogging the passage of fluid to the shower spray nozzle assemblies 12. To that end, the brush rod 24 has a threaded pinion section 31 which is disposed within a nut 31*a* fixed within the housing of the header, as disclosed in U.S. Application Ser. No. 60/651,413, filed Feb. 9, 2005, assigned to the same assignee as the present application, a disclosure which is incorporated herein by reference. Hence, as an incident to rotation of the rod in one direction, the pinion 31 moves axially to the left in the nut 31*a* as viewed in FIG. 1 causing the brush elements 26 to move with a combination of rotary and axial movement across the inlet ends of the nozzles 12 such that the bristles remove any debris or solid material that is encumbering or clogging the passage of cleaning fluid to the nozzles. Rotation of the rod in an opposite direction advances the brush end in an opposite axial direction. In the FIG. 1 embodiment, a motor 24 drives the movement of the cleaning brush assembly 22. Alternatively, the rotary movement of the cleaning brush assembly 22 can be hand driven via a handwheel 30 as in the embodiment illustrated in FIG. 2.

Figure 3:
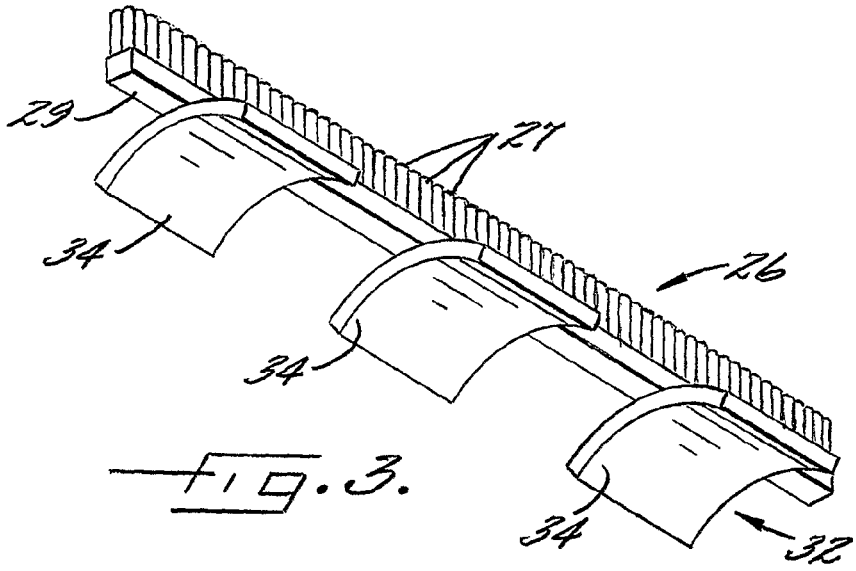
FIG. 3 is an enlarged perspective of one of the brush elements of the brush assembly of the illustrative shower header.
Figure 4:
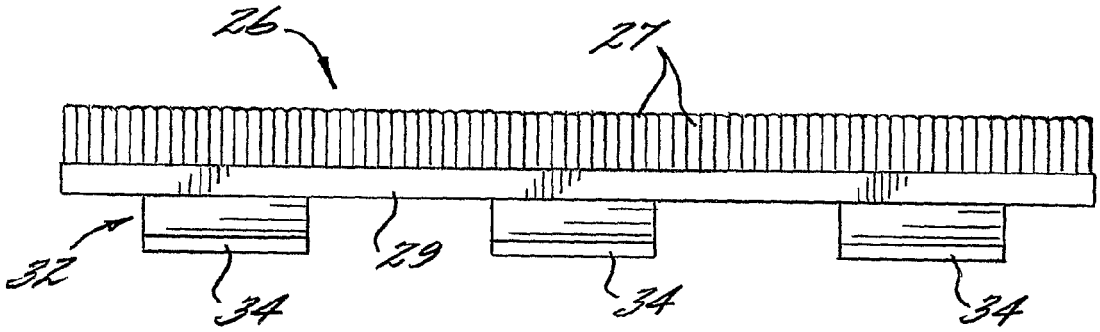
FIGS. 4 and 5 are side elevation and end views, respectively, of the brush element shown in FIG. 3.

According to one aspect of the present invention, in order to facilitate proper alignment of the cleaning bristles 27 relative to the brush rod 24 and thereby the shower header 10, each of the brush elements 26 has a self-aligning base member 32, as shown in FIG. 3, for the conventional brushes that will automatically orient the bristles properly when the brush element is placed on the brush rod. As indicated above, if the bristles 27 are not oriented properly they could interfere excessively with the inside wall of the shower header making rotation of the cleaning brush assembly 22 more difficult or even impossible. The original manufacture of the cleaning brush assembly typically uses special fixtures to ensure that the bristles 27 of the brush elements 26 are oriented properly. Using such special fixtures to replace worn brushes in the field is impractical.

With the present invention, the self-aligning base members 32 are configured such that when they engage the outer surface of the brush rod 24, the bristles 27 are automatically aligned properly relative to the axial centerline of the brush rod. The self-aligning base member 32 can simply be placed on the brush rod 24 and the brush element 26 welded in place with the bristles aligned properly. There is no need for any special fixtures or painstaking positioning to align the bristles properly. Thus, maintenance personnel can quickly and easily replace worn brushes in the field without having to ship the entire brush rod 24 back to the original manufacturer of the shower header or cleaning brush assembly.

Figure 5:
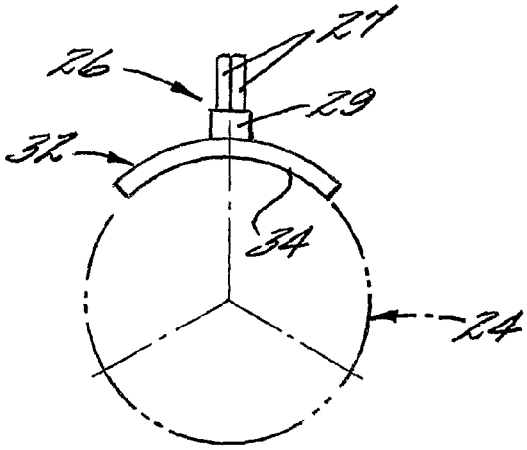

In the illustrated embodiment, each self-aligning base member 32 comprises a plurality of (in this case, three) arcuate saddle members 34 to which the brush support bar 29 of the brush element 26 can be attached (see FIG. 3). Each of the saddle members 34 has an inner radius that matches the outer radius of the brush rod 24. Each of the saddle members 34 should have a circumferential length that is sufficient to provide a stable support on the brush rod 24 without interfering with the saddle members 34 of the other brush elements 26 on the brush rod 24. As can be seen in FIG. 5, each saddle member 34 has a circumferential length substantially greater than the circumferential width of the row bristles 27, and in the illustrated embodiment, each saddle member 34 has a length of approximately one quarter of the outer circumference of the brush rod 24.

Figures 6, 7, 8, 9, 10:
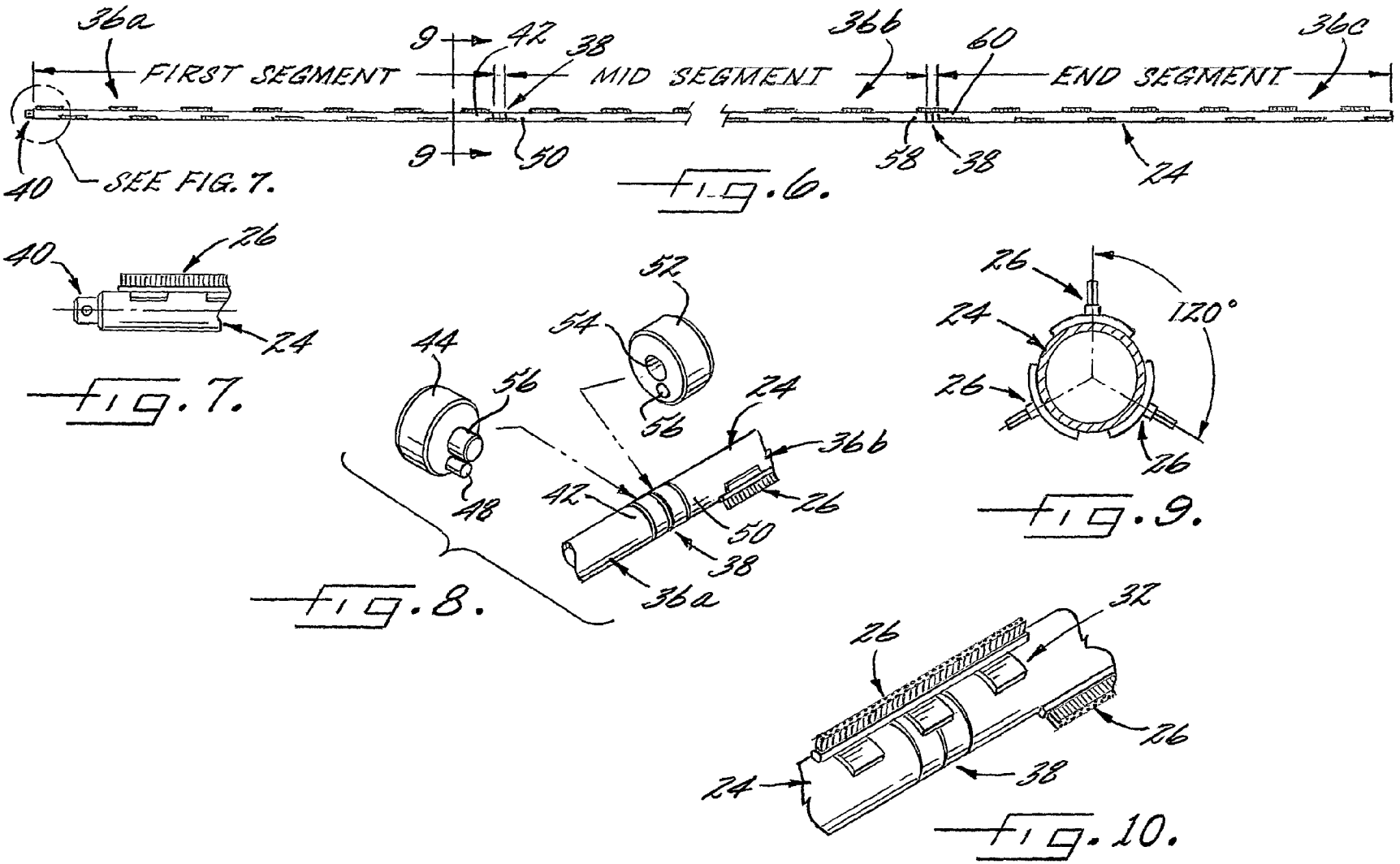
FIG. 6 is a side view of the illustrated brush assembly.
FIG. 7 is a side view of an end portion of the illustrated brush assembly.
FIG. 8 is a perspective of a juncture between individual brush rod segments of the illustrated brush assembly, illustrating self aligning coupling components thereof in exploded relation.
FIG. 9 is an enlarged vertical section of the illustrated brush assembly taken in the plane of 9-9 in FIG. 6.
FIG. 10 is a perspective of a section of the illustrated brush assembly showing a brush element mounted on the juncture between brush rod segments.

According to a further aspect of the present invention, in order to facilitate field replacement of the brush rod 24, the brush rod can have a modular construction that consists of a plurality of brush rod segments 36 such as shown in FIG. 6. Advantageously, these brush rod segments 36 can be assembled into a complete brush rod in the field. This substantially reduces the difficulty, time and cost associated with shipping replacement brush rods, particularly for applications involving relatively long brush rods. Moreover, to eliminate the need for special fixtures to center the brush rod in the shower header, each brush rod segment 36 includes one or more end couplings 38 that engage corresponding end couplings 38 on the other brush rod segments and maintains the concentricity of the assembled brush rod segments. The couplings 38 also ensure that the brush rod segments 36 have the desired rotational relationship to one another such that the desired continuous staggering (in this case, 120°) of the brush elements 26 is maintained when the segments are assembled together.

In the embodiment illustrated in FIG. 6, which includes three brush rod segments 36*a*, 36*b*, 36*c*, the first brush rod segment 36*a* includes a proximal end 40 that connects to the motor or handwheel via a standard pin connection. At the opposing distal end 42 of the first brush rod segment 36*a*, a coupling is provided that is configured as a male coupling 44 with a first center post 46 extending axially outward from the center of the distal end of the brush rod segment 36*a* and a second eccentrically located post 48 extending axially outward from the first segment. The proximal end 50 of the middle segment 36*b*, in turn, includes a female coupling 52 having a central recess 54 for receiving the center post 46 of the male coupling 44 and an eccentrically located recess 56 for receiving the second eccentric post 48 of the male coupling 44. As will be appreciated, the eccentrically located post 48 and recess 56 of the male and female couplings 44, 52 are arranged so that when the male and female couplings are engaged, the first and middle brush rod segments 36*a*, 36*b* will be in the desired rotational alignment relative to each other, e.g., so as to maintain the continuous 120° staggering of the brush elements. The distal end 58 of the middle segment 36*b* has a male coupling 44 like that at the distal end of the first brush segment while the end segment 36*c* has another female coupling 52 at its proximal end 60. The male and female couplings 44, 56 at the ends of the brush rod segments 36 can be separate elements that are attached to the hollow ends of the rod segments or can be formed directly into the ends of the rod segments. Once the brush rod segments 36 are assembled together in the proper orientation they can be secured together using any suitable method such as, for example, welding. It will be appreciated that any number of brush rod segments can be used.

In the embodiment illustrated in FIG. 6, a brush element with a self-aligning base 32 (FIG. 3) is used to bridge the seams between the different brush rod segments 36. The brush elements and self-aligning base members 32 can be secured in place on the brush rod segments 36 using any suitable method such as welding. In this regard, to facilitate the assembly of the brush elements 26 onto the brush rods 24, the thickness of the saddle members 34 preferably is approximately equal to the wall thickness of the brush rod 24. In this way, it will require substantially the same amount of heat to weld the saddle members 34 onto the brush rods 24 as is required to weld the segments 36 of the brush rod together, thus making the welding process much easier for the maintenance personnel doing brush replacement work in the field.

The modular brush rod is not limited to use with the self-aligning brush elements nor is it limited to replacement applications. For example, the modular brush rod can be configured to support only conventional base-less brush elements. The modular brush rod also has application for original equipment manufacturers (OEMs) of the shower headers or the cleaning brush assemblies. For instance, the brush rod segments could be held in inventory by the OEMs so that brush rods could be assembled in the plant with the original equipment without any special fixtures.

Likewise, while the brush elements with self-aligning base members have been described in connection with the modular brush rod of FIG. 6 it will be understood by those skilled in the art that the self-aligning brush elements are not limited to use on the modular brush rods. To the contrary, the brush elements with self-aligning base members can also be used in cleaning brush assemblies utilizing conventional solid one-piece brush rods.

From the foregoing, it can be seen that the shower headers of the present invention has a brush assembly with brush elements adapted for efficient mounting on a brush rod in precisely positioned relation with respect to an axis of the brush rod for more reliable operation. The brush assembly further is adapted for easy field replacement and repair without special locating fixtures and the like for the brush elements. The brush assembly further has a modular construction that is adapted for easy assembly with brush elements in properly oriented relation to each other and for less expensive shipment to customer sites or field locations.

What is claimed is:

1. A shower header spray device comprising:

an elongated spray header having a plurality of laterally spaced spray nozzles;

an elongated cleaning brush rotatably supported in said spray header for cleaning inlet apertures to said spray nozzles;

said cleaning brush including an elongated axially extending rod having a plurality of brush elements mounted on said rod in circumferentially offset relation to each other;

said brush elements each having an elongated row of cleaning bristles mounted in outwardly extending relation to an elongated support member;

said elongated support member of each brush element being mounted on a plurality of self-aligning base members disposed in axially spaced relation to said elongated support member and configured complementary to the outer circumferential configuration of said rod for orienting said row of bristles of the brush element in predetermined relation to an elongated axis of said rod as an incident to mounting of the brush element on the rod, and said self-aligning base members of each brush element extending circumferentially outwardly from opposite lateral sides of the row of bristles a distance greater than the circumferential width of the row of bristles.

2. The shower header spray device of claim 1 in which said rod has a cylindrical cross section and said self aligning base members are arcuate shaped saddles having an inner radius that matches the outer circumference of the brush rod.

3. The shower header spray device of claim 2 in which said self-aligning base member has a circumferential length corresponding to about ¼ of the circumference of said rod.

4. The shower header spray device of claim 1 in which said rod has a hollow cylindrical configuration, and said self aligning base member has a radial wall thickness substantially the same as said rod.

5. The shower header spray device of claim 1 in which said bristles of each brush element are disposed in parallel relation to the elongated axis of said rod.

6. The shower header spray device of claim 1 in which said rod includes a plurality of rod segments each having at least one brush element mounted thereon, and said rod segments each having a self aligning coupling at an axial end thereof, said axially self aligning coupling of adjacent rod segments being engageable to automatically orient the brush elements of the adjacent rod segment in predetermined angular offset relation to each other as an incident to assembly of the self aligning couplings.

7. The shower header spray device of claim 6 in which at least one of said rod segments has a male self aligning coupling comprising a center post extending outwardly from an axial end thereof and a second post extending axially from said axial end in eccentric relation to said center post, and at least one of said rod segments include a female self aligning coupling for mating with said male coupling comprising a central recess in an axial end thereof and a second recess in the same axial end as said central recess in eccentric relation to said central recess.

8. The shower header spray device of claim 1 in which said elongated support member is welded to said self-aligning base member, and said self-aligning base member is welded to said rod.

9. The shower header spray device of claim 1 in which said cleaning brush rod has a pinion disposed to impart simultaneous axial movement to the brush rod as an incident to rotation thereof.

10. A shower header spray device comprising:

an elongated spray header having a plurality of laterally spaced spray nozzles;

an elongated cleaning brush rotatably supported in said spray header for cleaning inlet apertures to said spray nozzles;

said cleaning brush comprising a plurality of brush rod segments each having at least one brush element mounted, said brush elements each having an elongated row of cleaning bristles extending from an elongated support member, said brush rod segments each being disposed in axially adjacent relation to each other, said brush rod segments each having a self aligning coupling at an axial end thereof oriented in predetermined relation to the brush element of the brush rod segment, said axially self aligning couplings of adjacently mounted brush rod segments being engageable to automatically orient the brush elements of the adjacently mounted rod segments in predetermined angular offset relation to each other as an incident to assembly of the self aligning couplings, said elongated support member of each brush element being mounted on a self-aligning base member configured complementary to an outer circumferential support surface of the brush rod segment; and said self-aligning base member of each brush element having a circumferential length greater than a circumferential width of the elongated bristle support member mounted thereon for orienting the row of bristles of each brush element in predetermined relation to an elongated axis of said cleaning brush as an incident to mounting of each brush element on the support surface of the brush rod segment.

11. The shower header spray device of claim 10 in which the self-aligning coupling of at least one of said brush rod segments is a male self aligning coupling comprising a center post extending outwardly from an axial end thereof and a second post extending axially from said axial end in eccentric relation to said center post, and the self-aligning coupling of at least one other of said brush rod segments is a female self aligning coupling for mating with said male coupling comprising a central recess in an axial end thereof and a second recess in the same axial end as said central recess in eccentric relation to said central recess.

12. The shower header spray device of claim 10 in which each said brush rod segment has a hollow rod section, and said self-aligning couplings are separate coupling elements that are fixed to the end of the rod section.

13. The shower header spray device of claim 10 in which the self-aligning coupling of one of said adjacently mounted brush segments has a center post extending outwardly from an axial end thereof and the self-aligning coupling of the other of the adjacently mounted brush segments has an axial recess for receiving the center post of the other adjacently mounted brush segment, and self-aligning coupling one of said adjacently mounted brush segments having a keying lug surface, and the self-aligning coupling the other of the adjacently mounted brush rod segments having a recess for receiving the keying lug surface of the adjacently mounted brush segment for orienting the adjacently mounted rod segments in predetermined angular orientation with respect to each other.

14. A shower header spray device comprising:

an elongated spray header having a plurality of laterally spaced spray nozzles;

an elongated cleaning brush rotatably supported in said spray header for cleaning inlet apertures to said spray nozzles;

said cleaning brush including an elongated axially extending rod having a plurality of brush elements mounted on said rod in circumferentially offset relation to each other;

said brush elements each having an elongated row of cleaning bristles extending from an elongated support member;

said bristles of each brush element being mounted in outwardly extending relation from said elongated support member, said elongated support member of each brush element being mounted on a self-aligning base member configured complementary to the outer configuration of said rod; and said self-aligning base of each brush element having a circumferential length greater than the circumferential width of the elongated bristle support member mounted thereon for orienting said row of bristles in predetermined relation to an elongated axis of said rod as an incident to mounting of the brush element on the rod.

* * * * *